US005409396A

United States Patent [19]

Bowen et al.

[11] Patent Number: 5,409,396

[45] Date of Patent: Apr. 25, 1995

[54] STRAIN RELIEF MEANS IN AN ELECTRICAL CONNECTOR ASSEMBLY FOR RIBBON CABLE

[75] Inventors: David C. Bowen, Downers Grove; Jerry A. Long, Elgin, both of Ill.

[73] Assignee: Molex Incorporated, Lisle, Ill.

[21] Appl. No.: 201,286

[22] Filed: Feb. 22, 1994

[51] Int. Cl.[6] ..... H01R 13/58

[52] U.S. Cl. ..... 439/465; 439/470

[58] Field of Search ..... 439/465, 470, 472, 473, 439/492, 496, 497

[56] References Cited

U.S. PATENT DOCUMENTS

| | | | |
|---|---|---|---|
| 4,139,727 | 2/1979 | Kuballa | 439/465 X |
| 4,925,401 | 5/1990 | Fogg et al. | 439/465 |
| 5,007,856 | 4/1991 | Puerner | 439/465 X |
| 5,114,362 | 5/1992 | Olsson | 439/460 |

*Primary Examiner*—Eugene F. Desmond
*Attorney, Agent, or Firm*—A. A. Tirva

[57] ABSTRACT

A cable strain relief system is provided for an electrical connector assembly which terminates a multi-conductor ribbon cable. A pair of interengageable elongated strain relief members clamp the ribbon cable therebetween. A flexible latch arm with a latch hook is provided on at least one of the strain relief members. A latch passage and a latch shoulder is provided on at least the other of the strain relief members for receiving the latch arm and latchingly engaging the latch hook of the one strain relief member. A rigid alignment element is provided on at least one of the strain relief members, and an alignment opening is provided on at least the other of the strain relief members for receiving the rigid alignment element. The latch passage is sized to receive the latch arm and latch hook freely thereinto with the pair of strain relief members offset relative to each other, and with the latch arm in an initial unflexed condition. The rigid alignment element is adapted to be inserted into the alignment opening after the latch arm has been inserted into the latch passage to draw the offset strain relief members laterally into alignment and to guide the members into fully engaged and latched condition with the latch arm flexed and the latch hook engaged with the latch shoulder.

11 Claims, 3 Drawing Sheets

STRAIN RELIEF MEANS IN AN ELECTRICAL CONNECTOR ASSEMBLY FOR RIBBON CABLE

FIELD OF THE INVENTION

This invention generally relates to the art of electrical connectors and, particularly, to an electrical connector assembly for terminating a multi-conductor ribbon cable, the invention particularly relating to an improved strain relief means for such a connector assembly.

BACKGROUND OF THE INVENTION

Electrical connectors have been provided in a wide variety of configurations for terminating multi-conductor cables, both discrete wire cables and integral flat or ribbon cables. With the ever-increasing miniaturization of electrical connectors and the ever-increasing numbers of wires in multi-conductor cables, electrical connectors of the character described have become increasingly complicated in order to accommodate relatively large numbers of conductors terminated in relatively small connectors.

Because of the miniaturization of such electrical connectors, extraneous connector hardware for facilitating assembly of the connector components practically has been made prohibitive, and assembly of the connectors often must be accomplished by interengageable and complementarily configured connector components which are assembled together by elements or parts of the components themselves fitting together in a fixed relationship in final assembly. This becomes very difficult to accomplish and still provide desirable features in the connector, such as guide means for the discrete wires, trimming the wires or conductors to appropriate lengths, isolating exposed ends of the conductors, providing strain relief for the cable as well as the conductors, providing ground connections for drain wires in the cable, providing reliable connections between the shielding components of the connector and other features which would appear to be impossible to incorporate in a single, small connector for a large number of conductors and respective terminals.

One of the problem areas in electrical connector assemblies described immediately above, is in the means for providing strain relief for the ribbon cable. Heretofore, the connector assembly generally has included a base assembly mounting a plurality of terminals, along with an elongated cover member holding the ribbon cable terminated against a rear face of the base assembly. A strain relief means is connected to the cover member and holds the ribbon cable at the rear of the cover member. Heretofore, a type of strain relief means has included a pair of interengageable elongated strain relief members for clamping the ribbon cable therebetween. At least one of the strain relief members has a flexible latch arm with a latch hook on the end thereof insertable into a latch opening in the other strain relief member. The latch arm flexes laterally and the latch hook snaps behind a latch shoulder on the other strain relief member when the pair of strain relief members are fully interengaged. At least one of the strain relief members has a rigid alignment element or arm insertable into an alignment passage in the other strain relief member to guide the pair of strain relief members into their fully engaged and latched positions.

The problem with the two-piece strain relief means described immediately above is that, during assembly, the rigid alignment arm guides the two strain relief members together and prevents any lateral movement between the strain relief members as the resilient latch arms flex and exert lateral forces between the strain relief members during assembly. These lateral forces create stresses in the strain relief members, require undue assembly forces and the rigid alignment arms and alignment passages are unduly large.

The present invention is directed to solving the above problems by providing an improved system for assembling the strain relief members, considerably reducing the size of the rigid alignment arms and considerably reducing the assembly forces required during total assembly.

SUMMARY OF THE INVENTION

An object, therefore, of the invention is to provide a new and improved strain relief means in an electrical connector assembly for terminating a multi-conductor ribbon cable.

In the exemplary embodiment of the invention, the electrical connector assembly includes a base assembly having a dielectric housing which mounts a plurality of terminals extending between a front mating face and a rear cable-receiving face of the base assembly. An elongated cover holds the ribbon cable with the individual conductors thereof in terminating condition against the rear cable-receiving face of the base assembly. Generally, a strain relief means are provided for connection to the cover and holding the ribbon cable at the rear of the cover. Specifically, a pair of interengageable elongated strain relief members are provided for clamping the ribbon cable therebetween. At least one of the strain relief members has a flexible latch arm with a latch hook on the end thereof insertable into a latch opening in the other strain relief member. The latch arm flexes laterally and the latch hook snaps behind a latch shoulder on the other strain relief member when the pair of strain relief members are fully interengaged. At least one of the strain relief members has a rigid alignment element insertable into an alignment opening in the other strain relief member to guide the pair of strain relief members into their fully engaged and latched condition.

The invention contemplates that the flexible latch arm and latch hook be freely insertable into the latch opening with the pair of strain relief members being laterally offset relative to each other. In this condition, the latch arm is in an initial unflexed condition. The rigid alignment element is adapted to be sequentially insertable into the alignment opening to draw the offset strain relief members laterally into alignment and guide the members into fully engaged and latched condition with the latch arm flexed and the latch hook snapped behind the latch shoulder.

As disclosed herein, the latch opening is in the form of a passage having a given length and width to receive the latch arm and latch hook freely therethrough. The rigid alignment element has a length shorter than the given length of the passage. In the preferred embodiment, the rigid alignment element is in the form of a camming boss having a length of approximately one-third the length of the latch arm. The camming boss is disclosed as a triangular-shaped boss, and the alignment opening is a complementary triangular-shaped recess.

Still further, the preferred embodiment illustrates one of the flexible latch arms and latch openings being provided at each opposite end of the strain relief means. One of the rigid alignment elements and alignment openings also are provided at each opposite end of the strain relief means. This is accomplished in a simple manner by providing the strain relief members of identical construction and interengageable as mirror images of each other, with one of the flexible latch arms and alignment openings at one end of each member and one of the rigid alignment elements and latch openings at the opposite end of each member.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
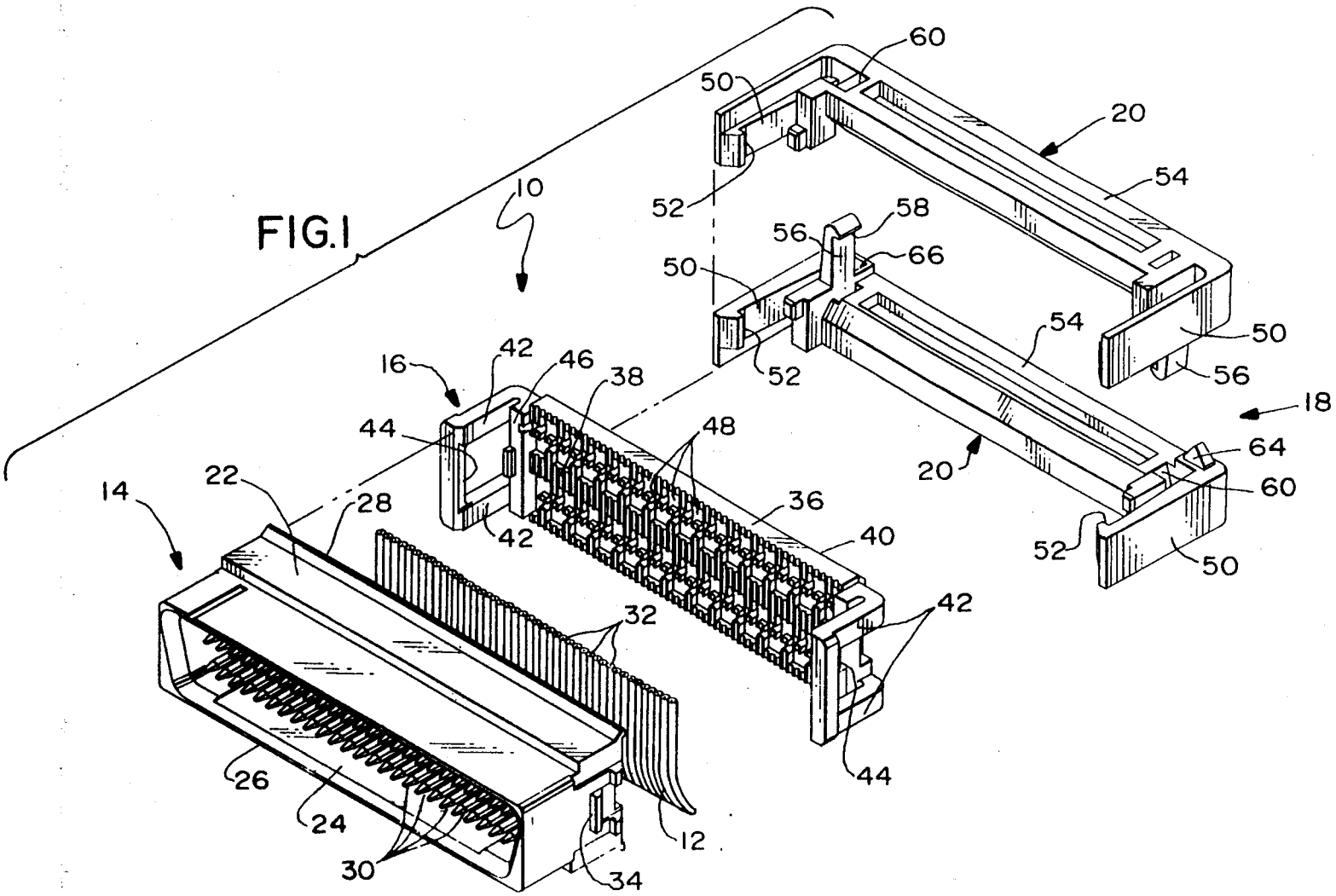
FIG. 1 is an exploded perspective view of an electrical connector assembly incorporating the strain relief means of the invention.
Figure 2:
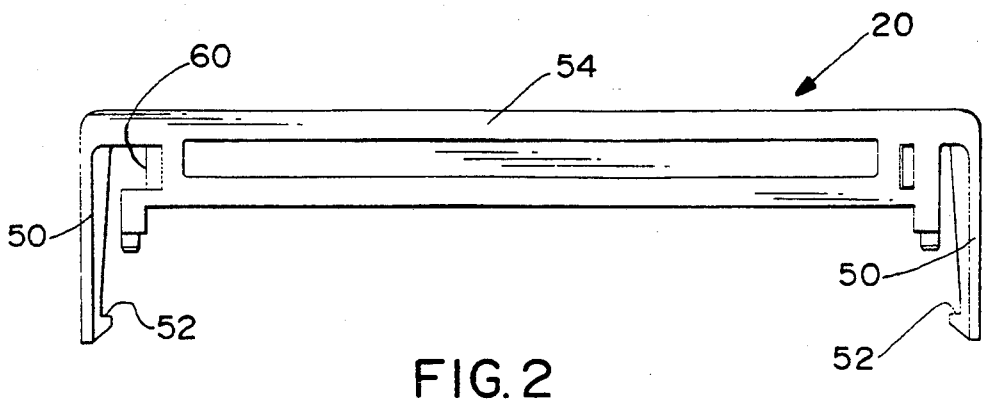
FIG. 2 is a top plan view of the top strain relief member in FIG. 1.
Figure 3:
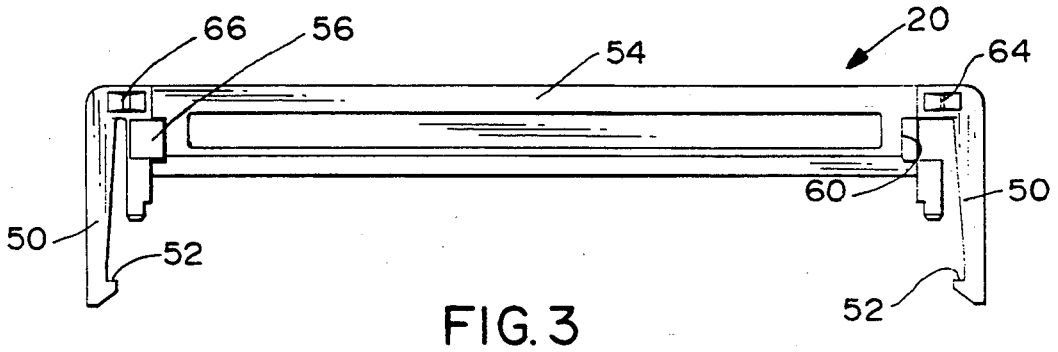
FIG. 3 is a top plan view of the bottom strain relief member in FIG. 1.

Referring to the drawings in greater detail, and first to FIG. 1, the invention is incorporated in an electrical connector assembly, generally designated 10, for terminating a multi-conductor ribbon cable 12. Electrical connector assembly 10 includes a base assembly, generally designated 14; an elongated cover member, generally designated 16; and a strain relief means, generally designated 18, which includes a pair of interengageable elongated strain relief members, generally designated 20.

More particularly, base assembly 14 includes a dielectric housing 22 integrally molded such as of plastic material. The housing has a front shroud 24 defining a front mating face 26, along with a rear cable-receiving face 28. A plurality of terminals 30 are mounted in housing 22 and extend between the front mating face and the rear cable-receiving face thereof. The terminals have pin portions located within shroud 24 for mating with the socket portions of the terminals of a complementary mating connector (not shown). As is known, the terminals have generally U-shaped insulation displacement portions at the rear cable-receiving face 28 for insulation-displacement termination to individual conductors 32 of ribbon cable 12. Lastly, housing 22 has a chamfered latch boss 34 projecting from each opposite end thereof.

Elongated cover 16 is provided for holding ribbon cable 12 with the individual conductors 32 thereof in terminating condition against rear cable-receiving face 28 of housing 22 of base assembly 14. Specifically, cover 16 has an elongated body 36 defining a front undulated face 38 and a rear face 40. Flexible latch arms 42 at opposite ends of body 36 have openings 44 for latchingly engaging latch bosses 34 of housing 22. Latch shoulders or surfaces 46 also are provided, for purposes described hereinafter. A plurality of holes 48 are formed in body 36 for receiving the insulation displacement portions of terminals 30. The undulated front face 38 of cover 16 defines a plurality of troughs, as clearly seen in FIG. 1, which effectively engage the undulated surface of ribbon cable 12 and effectively align or register conductors 32 of the cable with holes 38 and the insulation displacement portions of terminals 30.

Each strain relief member 20 of strain relief means 18 has a flexible connecting arm 50 at each opposite end thereof, and each connecting arm has a hook portion 52 for snapping behind latch shoulder or surface 46 at the respective adjacent end of cover 16 to interconnect the strain relief means at rear face 40 of the cover.

At this point, it should be understood that strain relief means 18 is provided by a pair of strain relief members 20 which are identical in construction and are interengageable as mirror images of each other. In other words, the strain relief members are shown in FIG. 1 with the top strain relief member being turned upside-down relative to the bottom strain relief member. Therefore, when looking at FIG. 1, the upper side of the top strain relief member is identical to the lower side of the bottom strain relief member and, conversely, the upper side of the bottom strain relief member is identical to the lower side of the top strain relief member.

With the above understanding of the identical construction of strain relief members 20, reference now is made to FIGS. 2–5 in conjunction with FIG. 1. In particular, each strain relief member 20 includes the flexible connecting arms 50 and hooks 52 described above. The connecting arms are located at opposite ends of an elongated body 54 extending between the connecting arms. When the two strain relief members are fully assembled or interengaged, as described hereinafter, the ribbon cable is sandwiched between bodies 54 of the two members.

Strain relief members 20 are assembled or interengaged by providing a flexible latch arm 56 with a latch hook 58 on one end of each member and projecting toward the opposite member for insertion into a latch opening 60 in the other member. During complete assembly, latch arm 56 flexes laterally and latch hook 58 snaps behind a surface 62 of body 54 at an edge of latch opening 60. Actually, the latch opening is a passage extending completely through body 54. The opening or passage is of a size for freely receiving latch arm 56 and latch hook 58 thereinto, for purposes described hereinafter.

Figure 4:
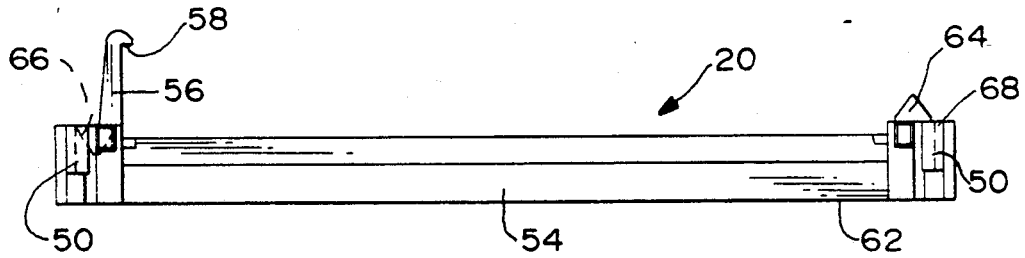
FIG. 4 is a front elevational view of the bottom strain relief member in FIG. 1.
Figure 5:
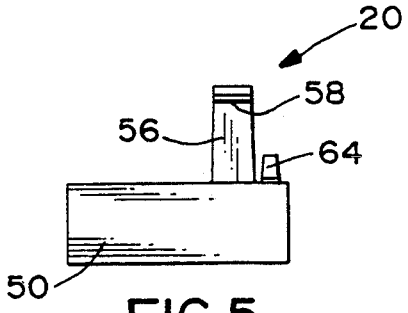
FIG. 5 is an end elevational view looking toward the right-hand end of FIG. 4.

Each elongated strain relief member 20 also includes a rigid alignment element 64 at the end of the member opposite latch arm 56. The alignment element projects in the same direction as the latch arm and is receivable in an alignment opening 66 of the other strain relief member when the members are fully interengaged. As best seen in FIG. 4, the rigid alignment element 64 is a short stub-like, triangular-shaped boss. Correspondingly, alignment opening 66 is of triangular shape. Therefore, the triangular-shaped bosses provide camming means to cam the pair of strain relief members laterally into fully interengaged positions. Lastly, rigid alignment element 64 projects from a surface 68 of the strain relief member a distance of approximately one-third the distance between surface 68 and hook 58 of latch arm 56. Therefore, the latch arm and latch hook of one strain relief member freely moves in latch passage 60 of the other strain relief member approximately two-thirds of the interengaging movement of the members before rigid alignment elements 64 enter alignment recesses 66.

Figure 6:
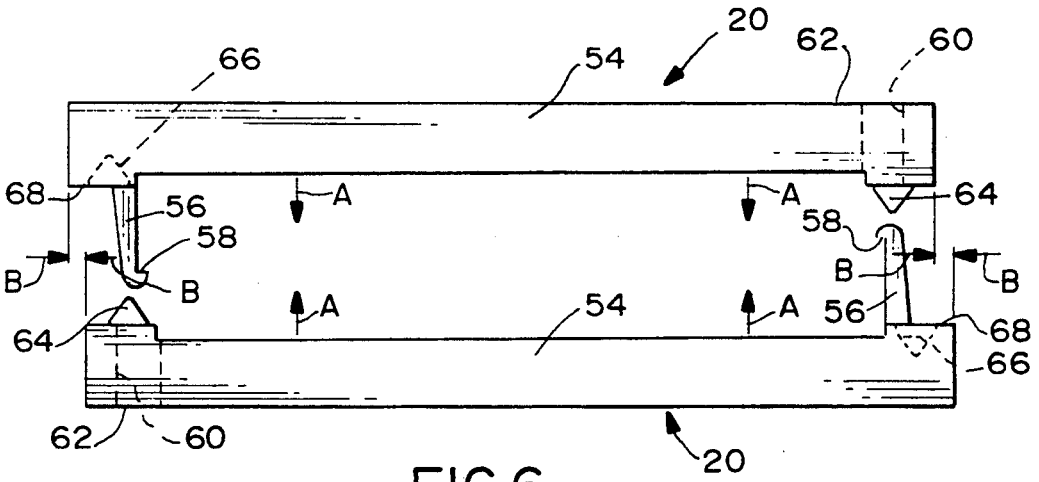
FIG. 6 is a rear elevational view of the pair of strain relief members in position for assembly but prior to assembly.
Figure 7:
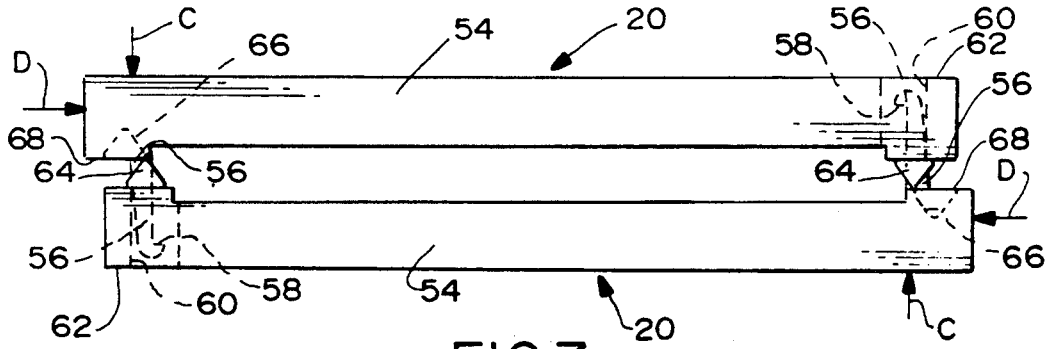
FIG. 7 is a view similar to that of FIG. 6, but with the flexible latch arm of each strain relief member freely inserted into the latch passage of the other member, and with the members being offset.
Figure 8:
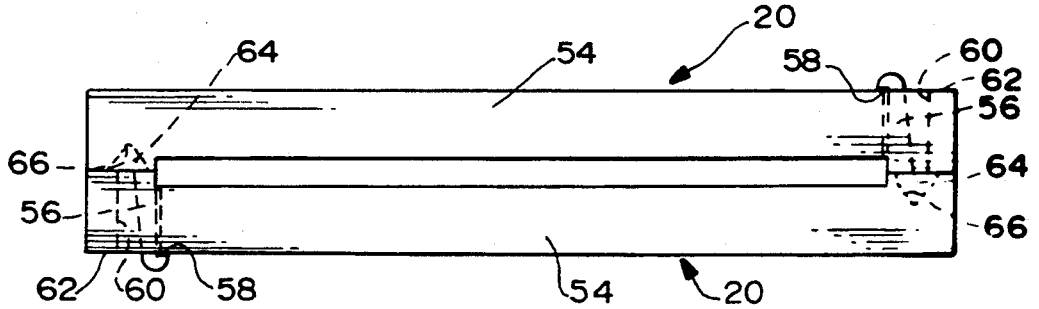
FIG. 8 is a view similar to that of FIGS. 6 and 7, but with the strain relief members in fully interengaged or assembled condition.

Reference now is made to FIGS. 6–8 to show the sequence of interengaging or assembling strain relief members 20. Referring first to FIG. 6, the strain relief members are interengaged by moving the members towards each other in the direction of arrows "A". It can be seen that the members are longitudinally offset relative to each other as indicated by arrows "B". In this offset orientation, latch arms 56 and latch hooks 58 can move into latch passages 60 freely without any substantial interference whatsoever. The two strain relief members are moved together until rigid alignment bosses 64 abut against surfaces 68 of the opposite strain relief member, as shown in FIG. 7.

In the relative positions of strain relief members 20 in FIG. 7, latch arms 56 and latch hooks 58 have moved approximately two-thirds of the distance into latch passages 60. Again, this movement, in essence, is accomplished with zero assembly forces.

In order to finally interengage or assemble strain relief members 20, forces are exerted on the members both toward each other as indicated by arrows "C" in FIG. 7, as well as longitudinally relative to each other in the direction of arrows "D". This will cause rigid alignment bosses 64 to enter alignment recesses 66 to draw the offset strain relief members laterally into alignment and guide the members into fully engaged and latched condition, with latch arms 56 flexed and latch hooks 58 snapped behind surfaces 62 of the opposite strain relief members. Therefore, the maximum interengaging forces are exerted only during the last part (e.g. one-third) of the total relative interengaging action between the two strain relief members.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector assembly for terminating a multi-conductor ribbon cable, the assembly including a base assembly having a dielectric housing which mounts a plurality of terminals extending between a front mating face and a rear cable-receiving face of the base assembly;

an elongated cover holding the ribbon cable with the individual conductors thereof in terminating condition against the rear cable-receiving face of the base assembly; and a strain relief means for connection to the cover and holding the ribbon cable at the rear of the cover, including a pair of interengageable elongated strain relief members for clamping the ribbon cable therebetween, at least one of the strain relief members having a flexible latch arm with a latch hook on the end thereof insertable into a latch opening in the other strain relief member, the latch arm flexing laterally and the latch hook snapping behind a latch surface on the other strain relief member when the pair of strain relief members are fully interengaged, and at least one of the strain relief members having a rigid alignment element insertable into an alignment opening in the other strain relief member to guide the pair of strain relief members into their fully engaged and latched condition, wherein the improvement comprises said flexible latch arm and latch hook being freely insertable into the latch opening with the pair of strain relief members being laterally offset relative to each other and with the latch arm in an initial unflexed condition, and said rigid alignment element being adapted to be sequentially insertable into the alignment opening to draw the offset strain relief members laterally into alignment and guide the members into fully engaged and latched condition with the latch arm flexed and the latch hook snapped behind the latch shoulder.

2. In an electrical connector assembly as set forth in claim 1, wherein said rigid alignment element comprises a triangular-shaped boss, and said alignment opening comprises a complementary triangular-shaped recess.

3. In an electrical connector assembly as set forth in claim 1, wherein said latch opening comprises a passage of a given length and width to receive the latch arm and latch hook freely therethrough, and said rigid alignment element has a length shorter than the given length of the passage.

4. In an electrical connector assembly as set forth in claim 3, wherein said rigid alignment element comprises a camming boss having a length of approximately one-third the length of the latch arm.

5. In an electrical connector assembly as set forth in claim 1, including one of said flexible latch arms and latch openings at each opposite end of the strain relief means.

6. In an electrical connector assembly as set forth in claim 5, including one of said rigid alignment elements and alignment openings at each opposite end of the strain relief means.

7. In an electrical connector assembly as set forth in claim 6, wherein said strain relief members are of identical construction and are interengageable as mirror images of each other with one of the flexible latch arms and alignment openings at one end of each member and one of the rigid alignment elements and latch openings at the opposite end of each member.

8. A cable strain relief system for an electrical connector assembly which terminates a multi-conductor ribbon cable, comprising:

a pair of interengageable elongated strain relief members for clamping the ribbon cable therebetween, a flexible latch arm with a latch hook on at least one of the strain relief members, a latch passage and a latch shoulder on at least the other of the strain relief members for receiving the latch arm and latchingly engaging the latch hook of the one strain relief member, a rigid alignment element on at least one of the strain relief members, an alignment opening in at least the other of the strain relief members for receiving the rigid alignment element, the latch passage being sized to receive the latch arm and latch hook freely thereinto with the pair of strain relief members offset relative to each other and, with the latch arm in an initial unflexed condition, and the rigid alignment element being adapted to be inserted into the alignment opening after the latch arm has been inserted into the latch passage to draw the offset strain relief members laterally into alignment and guide the members into fully engaged and latched condition with the latch arm flexed and the latch hook engaged with the latch shoulder.

9. The cable strain relief system of claim 8 wherein said flexible latch arm has a given length, and said rigid alignment element comprises a stub-like boss of a length substantially shorter than that of the flexible latch arm, and said alignment opening comprises a recess.

10. The cable strain relief system of claim 9 wherein said boss has an oblique camming surface for engaging a side of said recess and camming the strain relief members into alignment.

11. The cable strain relief system of claim 8 wherein said strain relief members are of identical construction and are interengageable as mirror images of each other with one of the flexible latch arms and alignment openings at one end of each member and one of the rigid alignment elements and latch openings at the opposite end of each member.

* * * * *